US011145990B2

(12) United States Patent
Tseng et al.

(10) Patent No.: US 11,145,990 B2
(45) Date of Patent: Oct. 12, 2021

(54) ANTENNA STRUCTURE HAVING MULTIPLE OPERATING FREQUENCY BANDS

(71) Applicant: WISTRON NEWEB CORPORATION, Hsinchu (TW)

(72) Inventors: Shih-Hsien Tseng, Hsinchu (TW); Cheng-Pang Chang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 444 days.

(21) Appl. No.: 16/208,604

(22) Filed: Dec. 4, 2018

(65) Prior Publication Data

US 2019/0296446 A1 Sep. 26, 2019

(30) Foreign Application Priority Data

Mar. 21, 2018 (TW) ..... 107109659

(51) Int. Cl.

| | |
|---|---|
| ***H01Q 5/335*** | (2015.01) |
| ***H01Q 9/04*** | (2006.01) |
| ***H01Q 9/16*** | (2006.01) |
| ***H01Q 1/24*** | (2006.01) |
| ***H01Q 1/48*** | (2006.01) |
| ***H01Q 19/00*** | (2006.01) |
| ***H01Q 7/00*** | (2006.01) |

(52) U.S. Cl.

CPC ..... *H01Q 19/005* (2013.01); *H01Q 1/242* (2013.01); *H01Q 1/48* (2013.01); *H01Q 5/335* (2015.01); *H01Q 7/00* (2013.01); *H01Q 9/0421* (2013.01); *H01Q 9/16* (2013.01)

(58) Field of Classification Search

CPC ..... H01Q 1/243; H01Q 5/321; H01Q 7/00; H01Q 5/378; H01Q 1/38; H01Q 1/521; H01Q 5/10; H01Q 5/328; H01Q 19/005; H01Q 5/335; H01Q 9/065; H01Q 5/392; H01Q 9/04; H01Q 5/357; H01Q 5/385; H01Q 9/42; H01Q 5/371

See application file for complete search history.

(56) References Cited

U.S. PATENT DOCUMENTS 8,552,912 B2 10/2013 Wang et al.
9,425,498 B2 * 8/2016 Lee ..... H01Q 9/42
(Continued)

FOREIGN PATENT DOCUMENTS

| | | |
|---|---|---|
| CN | 203660057 U | 6/2014 |
| CN | 107845857 A | 3/2018 |
| TW | M257522 | 2/2005 |

*Primary Examiner* — Vibol Tan

(74) *Attorney, Agent, or Firm* — McClure, Qualey & Rodack, LLP

(57) ABSTRACT

An antenna structure includes a substrate, a first radiating element, a second radiating element, a first inductor, a ground element, a first conducting element and a feeding element. The first radiating element is disposed on the substrate. The second radiating element is disposed on the substrate. The second radiating element includes a feed receiving portion. The first inductor is coupled between the first radiating element and the second radiating element. The first conducting element is coupled between the feed receiving portion and the ground element. The feeding element is coupled between the feed receiving portion and the ground element and for feeding in a signal.

19 Claims, 11 Drawing Sheets

(56) References Cited

U.S. PATENT DOCUMENTS

| | | | | |
|---|---|---|---|---|
| 9,450,302 | B2 * | 9/2016 | Lee | H01Q 1/243 |
| 10,389,024 | B2 * | 8/2019 | Tseng | H01Q 9/0421 |
| 2005/0190108 | A1 | 9/2005 | Lin et al. | |
| 2010/0053007 | A1 | 3/2010 | Ni et al. | |
| 2013/0016013 | A1 * | 1/2013 | Wong | H01Q 1/38 343/700 MS |
| 2013/0057443 | A1 * | 3/2013 | Asanuma | H01Q 9/30 343/751 |
| 2015/0061962 | A1 * | 3/2015 | Lee | H01Q 1/521 343/893 |
| 2018/0123244 | A1 * | 5/2018 | An | H01Q 9/285 |

* cited by examiner

ANTENNA STRUCTURE HAVING MULTIPLE OPERATING FREQUENCY BANDS

CROSS-REFERENCE TO RELATED PATENT APPLICATION

This application claims the benefit of priority to Taiwan Patent Application No. 107109659, filed on Mar. 21, 2018. The entire content of the above identified application is incorporated herein by reference.

FIELD OF THE DISCLOSURE

The present disclosure relates to an antenna structure, and more particularly to an antenna structure having multiple operating frequency bands.

BACKGROUND OF THE DISCLOSURE

With the increasing use of portable electronic devices (such as smart phones, tablet computers, and notebook computers), wireless communication technologies have become increasingly important in recent years. The quality of wireless communication depends on the efficiency of the antenna in a portable electronic device. Therefore, increasing the gain of the antenna has become an important issue in the art. Furthermore, although some existing antenna structures (for example, planar inverted-F antenna, PIFA) can generate multiple frequency bands, different frequency bands may affect one another, resulting in lower antenna matching effect.

In addition, with the advent of next generation communication technology—5G Licensed Assisted Access (LAA), the design of an existing antenna structure (for example, a PIFA) has been unable to meet the requirements of the application band of a fifth generation communication system. Although U.S. Pat. No. 8,552,912 (hereinafter "'912 Patent") discloses an "antenna for thin communication apparatus" which increases bandwidth by using ground segments, the fifth generation communication system has even higher demands for frequency bands and bandwidth, and the '912 Patent does not achieve the effect of covering simultaneously the 4G and 5G frequency bands.

SUMMARY OF THE DISCLOSURE

In response to the above-referenced technical inadequacies, the present disclosure provides an antenna structure covering simultaneously the 4G and 5G frequency bands and suppressing mutual influence between different frequency bands.

In certain aspects, the present disclosure directs to an antenna structure including a substrate, a first radiating element, a second radiating element, a first inductor, a ground element, a first conducting element and a feeding element. The first radiating element is disposed on the substrate. The second radiating element is disposed on the substrate. The second radiating element has a feed receiving portion.

The first inductor is coupled between the first radiating element and the second radiating element. The first conducting element is coupled between the feed receiving portion and the ground element. The feeding element is coupled between the feed receiving portion and the ground element and is for feeding in a signal.

One of the beneficial effects of the present disclosure is that, through the technical features of "the inductor being coupled between the first radiating element and the second radiating element," the antenna structure of the present disclosure can suppress the mutual influence between different frequency bands.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
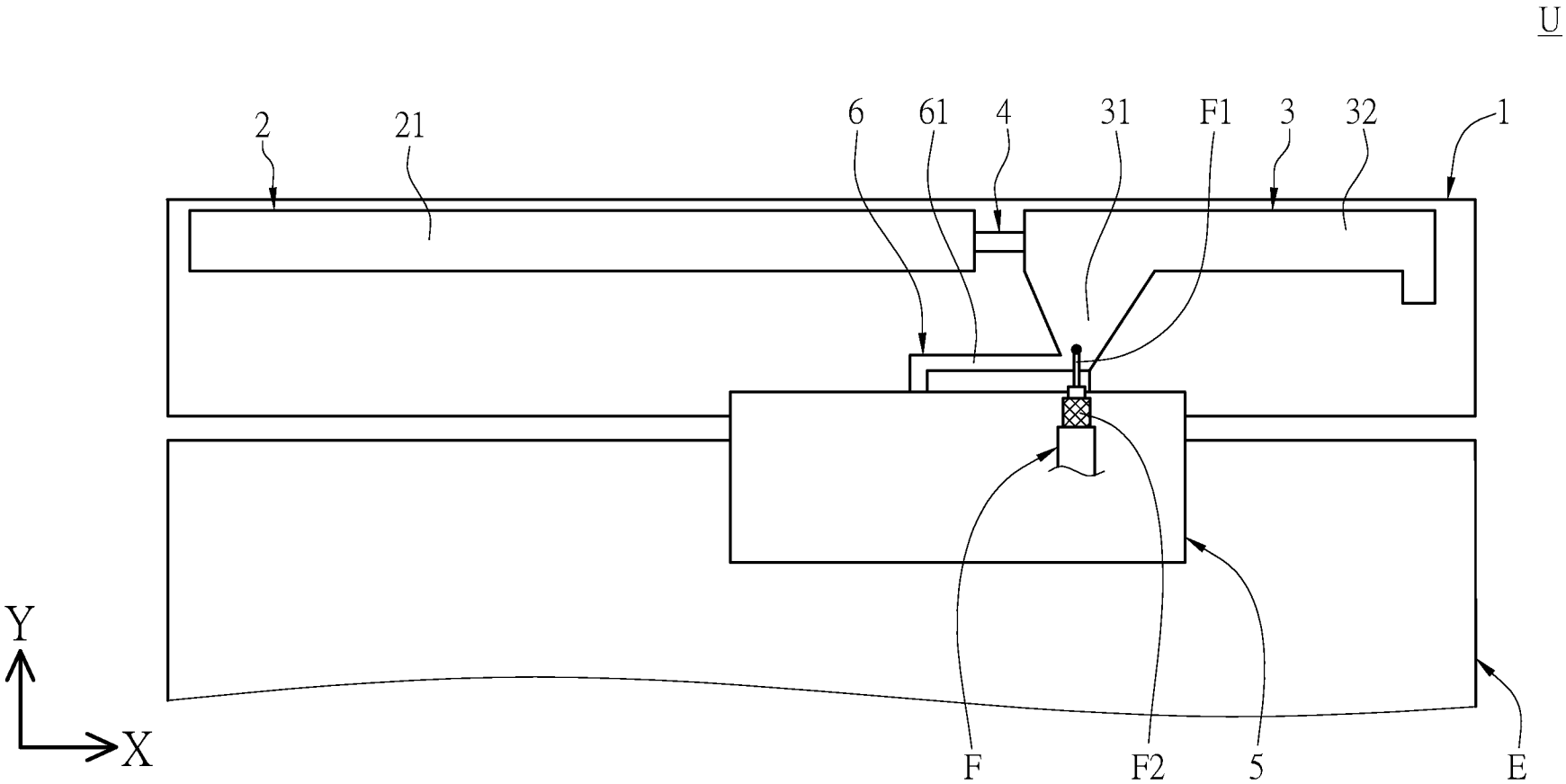
FIG. 1 is a top view of an antenna structure according to a first embodiment of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be expressed in more than one way. Consequently, alternative language and synonyms may be used for any one or more of the terms discussed herein, and no special significance is to be placed upon whether or not a term is elaborated or discussed herein. Synonyms for certain terms may be provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including any definitions given herein, will prevail.

While numbering terms such as "first", "second" or "third" may be used in this disclosure to describe various components, signals or the like, the terms are for distinguishing one component from another component, or one signal from another signal only, and are not intended to, nor should they be construed to impose any other substantive descriptive limitations on the components, signals or the like.

First Embodiment

Figure 2:
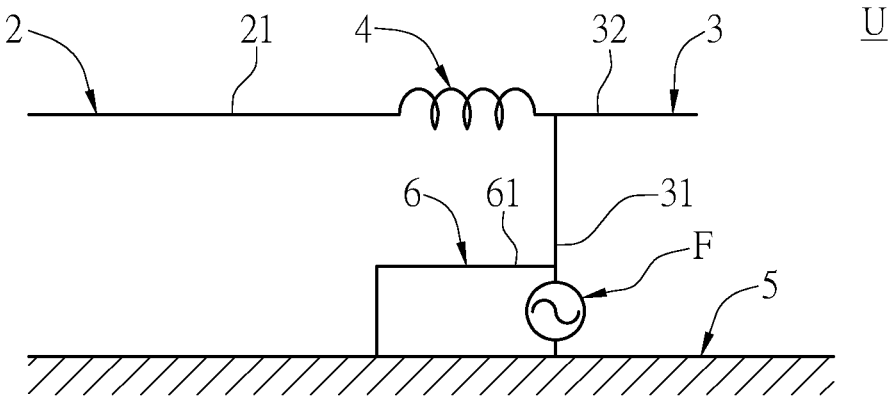
FIG. 2 is a schematic circuit architecture diagram of one configuration of an antenna structure according to a first embodiment of the present disclosure.
Figure 3:
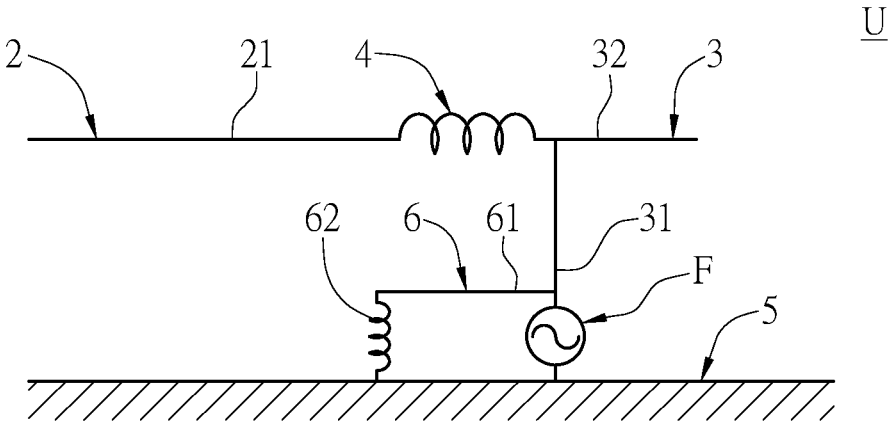
FIG. 3 is a schematic circuit architecture diagram of another configuration of an antenna structure according to the first embodiment of the present disclosure.

First, reference is made to FIG. 1 and FIG. 2. FIG. 1 is a top view of an antenna structure according to a first embodiment of the present disclosure, that is, a schematic view of an antenna structure implemented on a substrate. FIG. 2 is a schematic circuit architecture diagram of one configuration of the first embodiment of the antenna structure of the present disclosure. The present disclosure provides an antenna structure U including a substrate 1, a first radiating element 2, a second radiating element 3, a first inductor 4, a ground element 5, a first conducting element 6, and a feeding element F. The first radiating element 2, the second radiating element 3, the first inductor 4 and the first conducting element 6 can be disposed on the substrate 1, and the first inductor 4 can be coupled between the first radiating element 2 and the second radiating element 3. That is, one end (not labeled in the figure) of the first inductor 4 can be coupled to the first radiating element 2, and the other end (not labeled in the figure) of the first inductor 4 can be coupled to the second radiating element 3. In addition, the second radiating element 3 can have a feed receiving portion 31. The first conducting element 6 can be coupled between the feed receiving portion 31 of the second radiating element 3 and the ground element 5. Furthermore, the feeding element F can be coupled between the feed receiving portion 31 and the ground element 5 for feeding in a signal. In addition, the feeding element F can have a feeding terminal F1 and a ground terminal F2. The feeding terminal F1 can be coupled to the feed receiving portion 31, and the ground terminal F2 can be coupled to the ground element 5. In addition, it should be particularly noted that the term "be coupled to" or the like throughout the entire disclosure can refer to any of direct connection, indirect connection, direct electrical connection and indirect electrical connection. However, the present disclosure is not limited thereto.

Further, it is worth noting that the material of the substrate 1, the first radiating element 2, the second radiating element 3, the ground element 5 and the first conducting element 6 can be any kind of conducting material. And any of the above-referenced elements can be produced by any forming or molding process, whose description is omitted herein for brevity. For example, each of the first radiating element 2, the second radiating element 3 and the first conducting element 6 can be a metal sheet, a metal wire, or other kinds of conducting material having conducting effects. In certain embodiments, the substrate 1 can be a printed circuit board (PCB). In embodiments, the feeding element F can be a coaxial cable. However, the present disclosure is not limited to the above-identified examples. It should be noted that, in order to make the figures of the present disclosure easy to understand, in the figures of the present disclosure other than the schematic diagram of the antenna structure U implemented on the substrate 1 in FIG. 1, an alternative symbol in replacement of the structure of the coaxial cable F shown in FIG. 1 is used at least in FIGS. 2-8 and 12-19 to represent the structure of the coaxial cable in FIG. 1.

Further, referring again to FIG. 1 and FIG. 2, the second radiating element 3 can be integrally formed with the first conducting element 6. That is, the second radiating element 3 and the first conducting element 6 can be a metal sheet. In certain embodiments, the ground element 5 can be electrically connected to a metal conductor E, and the metal conductor E and the substrate 1 can be separated or spaced apart from each other. Further, the first radiating element 2 can include a first radiating portion 21, and the second radiating element 3 can further include a second radiating portion 32 connected to the feed receiving portion 31. The first radiating portion 21 can extend toward a first direction, and the second radiating portion 32 can extend toward a second direction. The first direction and the second direction can be different from each other. For example, in the embodiment of FIGS. 1 and 2, the first direction (negative direction of x axis in FIG. 1) and the second direction (positive direction of x axis in FIG. 1) are opposite to each other.

Further, referring again to FIG. 1 and FIG. 2, according to the first embodiment, the first radiating portion 21 can generate a first operating frequency band with a frequency range between 698 megahertz (MHz) and 960 MHz, and the second radiating portion 32 can generate a second operating frequency band with a frequency range between 1425 MHz and 5850 MHz, so that the antenna structure U is operable in the 4G Long Term Evolution (LTE) band and the 5G Licensed Assisted Access (LAA) band. However, the present disclosure is not limited thereto. In certain embodiments, for example, the second operating frequency band can include a first frequency band range between 1425 MHz and 2690 MHz, a second frequency band range between 3400 MHz and 3800 MHz, and a third frequency band range between 5150 MHz and 5850 MHz. However, the present disclosure is not limited thereto. In other words, in other embodiments, the second operating frequency band can include only the first frequency band range and the second frequency band range, only the second frequency band range and the third frequency band range, or only the first frequency band range and the third frequency band range. The present disclosure is not limited thereto. However, it should be particularly noted that, regarding the antenna structure U shown in FIG. 1 to FIG. 3, the second operating frequency band can further include a frequency band range between 4300 MHz and 4700 MHz. The antenna structure U provided in the first embodiment can operate in the first operating frequency band and the first frequency band range, the frequency band range between 4300 MHz and 4700 MHz and the third frequency band range of the second operating frequency band.

Further, for example, the first inductor 4 can have an inductance value between 1 nanohenries (nH) and 30 nH. However, the present disclosure is not limited thereto. In this way, by adopting the first inductor 4 arranged between the first radiating element 2 and the second radiating element 3, the signal of the first radiating element 2 can be prevented from influencing the signal of the second radiating element 3. That is, the matching effect of the second radiating element 3 can be increased, preventing the second radiating element 3 from being affected by the frequency multiplication of the first radiating element 2.

Further, referring again to FIG. 1 and FIG. 2, for example, in the embodiments of FIGS. 1 and 2, the first conducting element 6 can have a first conducting body 61. One end (not labeled in the figure) of the first conducting body 61 can be coupled to the feed receiving portion 31, and the other end (not labeled in the figure) of the first conducting body 61 can be coupled to the ground element 5. However, the present disclosure is not limited thereto. Next, reference is made to FIG. 3, which is a circuit architecture diagram of another configuration of an antenna structure according to the first embodiment of the present disclosure. From the comparison between FIG. 3 and FIG. 2, it can be seen that in the embodiment of FIG. 3, the first conducting element 6 can include a first conducting body 61 and a second inductor 62 connected to the first conducting body 61. One end of the first conducting body 61 can be coupled to the feed receiving portion 31, the other end of the first conducting body 61 can be coupled to one end of the second inductor 62 (not labeled in the figure), and the other end of the second inductor 62 (not labeled in the figure) can be coupled to the ground element 5. In addition, for example, the second inductor 62 can have an inductance value between 2.7 nH and 15 nH. However, the present disclosure is not limited thereto. Therefore, by adjusting the inductance of the second inductor 62, the impedance value corresponding to the center frequency of the first operating frequency band can be adjusted.

Further, it is worth noting that, referring again to FIG. 1 to FIG. 3, in other embodiments, the antenna structure U can further include a first capacitor (not shown in the figure) and a second capacitor (not shown in the figure). The first capacitor can be coupled between the first radiating element 2 and the second radiating element 3, and can be connected in series with the first inductor 4. In addition, the second capacitor can be coupled between the feed receiving portion 31 and the ground element 5, and can be connected in series with the second inductor 62. It should be noted that in other embodiments, the antenna structure U can be configured with only one of the first capacitor or the second capacitor. Also, by adopting the first capacitor and/or the second capacitor, the impedance value of the first operating frequency band and/or the second operating frequency band can be adjusted, and the frequency range of the first operating frequency band and/or the second operating frequency band can also be adjusted.

Second Embodiment

Figure 4:
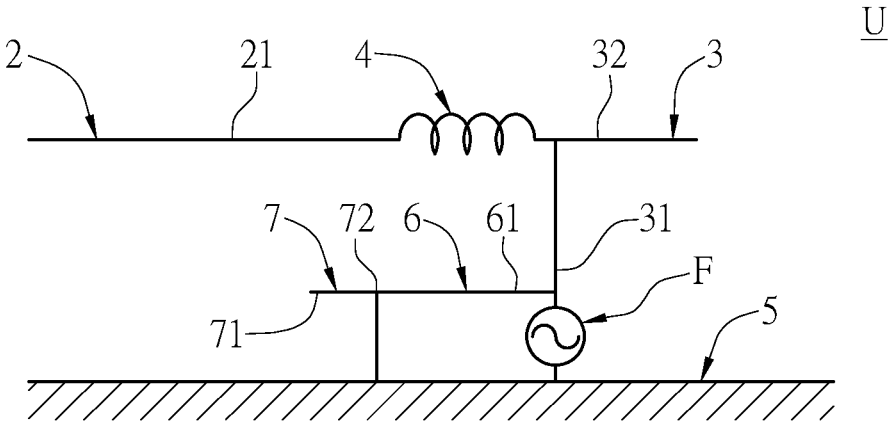
FIG. 4 is a schematic circuit architecture diagram of one configuration of an antenna structure according to a second embodiment of the present disclosure.

First, reference is made to FIG. 4, which is a circuit architecture diagram of one configuration of an antenna structure according to a second embodiment of the present disclosure. From the comparison between FIG. 4 and FIG. 2, it can be seen that one of the differences between the second embodiment and the first embodiment is the antenna structure U provided by the second embodiment can further include a stub 7. As a result, by adopting the stub 7, the center frequency of the third frequency band range within the second operating frequency band can be adjusted.

Further, the stub 7 can be disposed on the substrate 1 and integrally formed with the first conducting element 6 and the second radiating element 3. The stub 7 can have an open end 71 and a connecting end 72 coupled to the first conducting element 6. The location of the connecting end 72 of the stub 7 is defined as a location on the stub 7 corresponding to a first node counted from the open end 71 of the stub 7. In addition, the length between the open end 71 and the connecting end 72 can be adjusted so as to further adjust the center frequency of the third frequency band range within the second operating frequency band. In other words, in comparison with the first embodiment, by adopting the stub 7, the second embodiment can adjust the center frequency of the third frequency band range within the second operating band toward lower frequency by extending the length of the stub 7.

Figure 5:
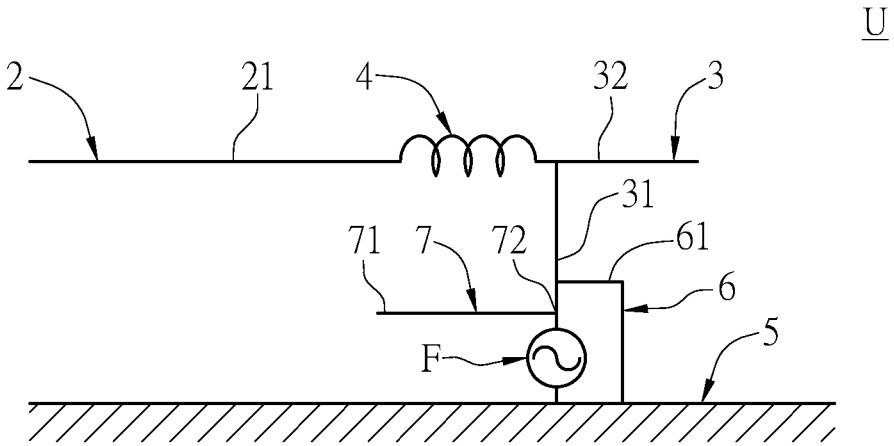
FIG. 5 is a schematic circuit architecture diagram of another configuration of an antenna structure according to the second embodiment of the present disclosure.

Next, reference is made to FIG. 5, which is a circuit architecture diagram of another configuration of an antenna structure according to the second embodiment of the present disclosure. From the comparison between FIG. 5 and FIG. 2, it can be seen that in the embodiment of FIG. 5, the stub 7 can have an open end 71 and a connecting end 72 coupled to the feed receiving portion 31. In addition, the stub 7 can be disposed on one side of the feed receiving portion 31, and the first conducting element 6 can be disposed on the other side of the feed receiving portion 31.

Figure 6:
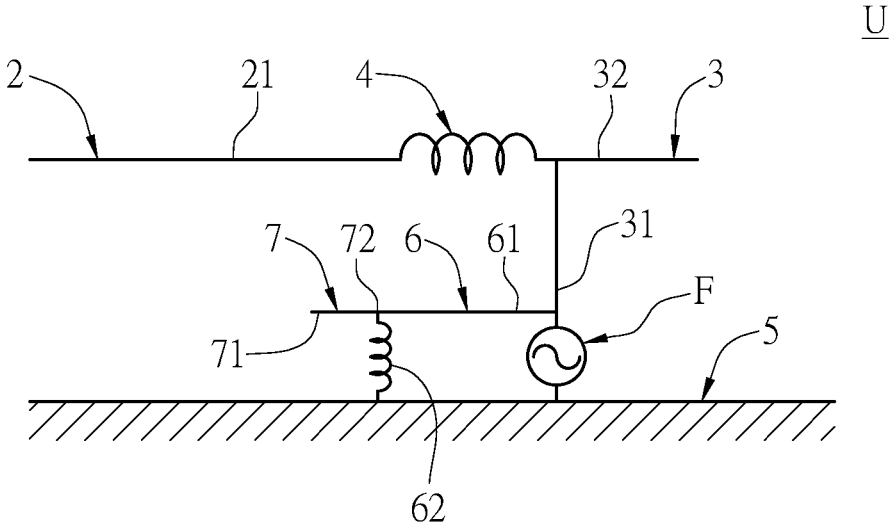
FIG. 6 is a schematic circuit architecture diagram of still another configuration of an antenna structure according to the second embodiment of the present disclosure.

Next, referring to FIG. 6, the first conducting element 6 can include a first conducting body 61 and a second inductor 62. One end of the first conducting body 61 is coupled to the feed receiving portion 31, and the other end of the first conducting body 61 is coupled to the connecting end 72 of the stub 7. One end of the second inductor 62 is coupled to the location where the other end of the first conducting body 61 and the connecting end 72 of the stub 7 connect to each other, and the other end of the second inductor 62 is coupled to the ground element 5. In addition, it should be particularly noted that the frequency band in which the antenna structure U provided by the second embodiment is operable is similar to that of the first embodiment. And one of the differences between the second embodiment and the first embodiment is that, by adopting the stub 7, the antenna structure U provided by the second embodiment can adjust the center frequency of the third frequency band range within the second operating frequency band. The other structural features shown in the second embodiment are similar to those described in the foregoing embodiment(s), and are not to be repeated herein.

Third Embodiment

Figure 7:
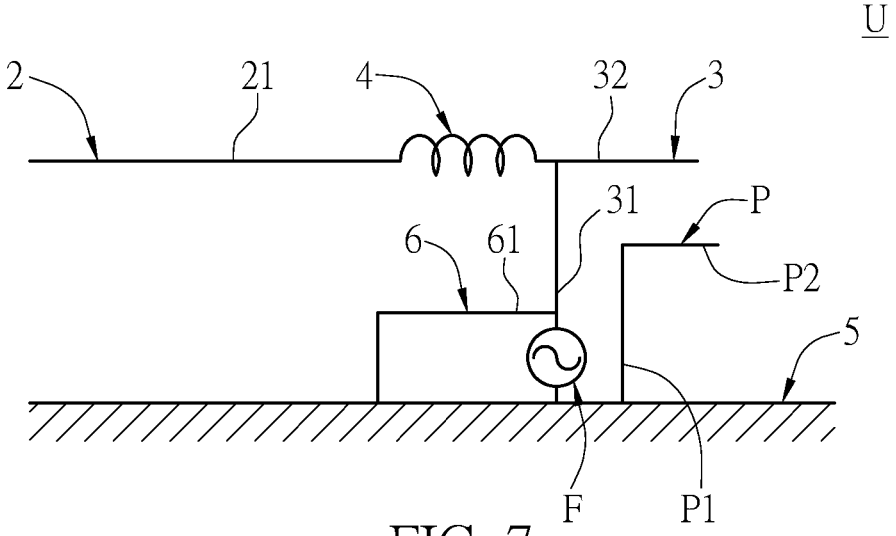
FIG. 7 is a schematic circuit architecture diagram of one configuration of an antenna structure according to a third embodiment of the present disclosure.

First, reference is made to FIG. 7, which is a circuit architecture diagram of one configuration of an antenna structure according to a third embodiment of the present disclosure. From the comparison between FIG. 7 and FIG. 2, it can be seen that one of the differences between the third embodiment and the first embodiment is that, the antenna structure U provided by the third embodiment can further include a parasitic element P, thereby increasing the gain of the first frequency band range and the second frequency band range within the second operating frequency band.

Further, the parasitic element P can be disposed on the substrate 1 and adjacent to the second radiating portion 32. In certain embodiments, one end of the parasitic element P can be coupled to the ground element 5. In the third embodiment, the parasitic element P can have a first parasitic portion P1 coupled to the ground element 5 and a second parasitic portion P2 bent from the first parasitic portion P1 and extending toward a direction away from the feed receiving portion 31.

Figure 8:
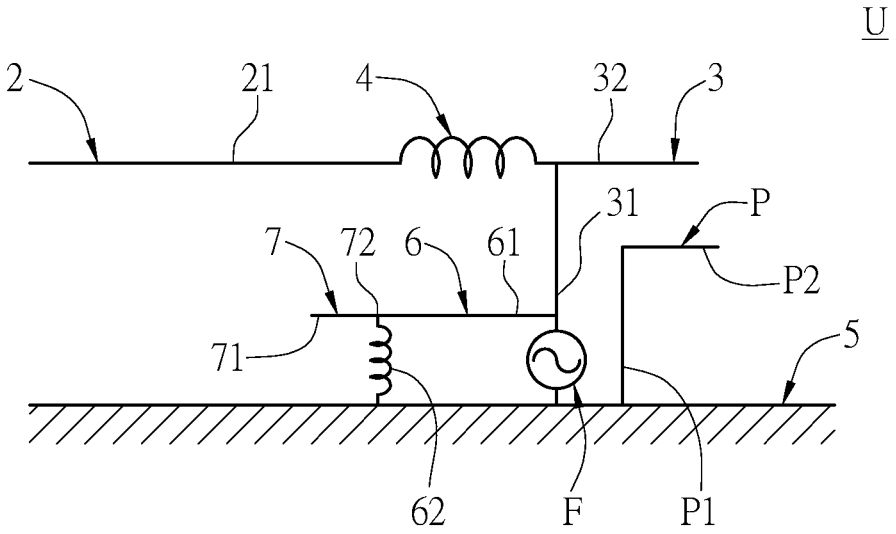
FIG. 8 is a schematic circuit architecture diagram of another embodiment of an antenna structure according to the third embodiment of the present disclosure.
Figure 9:
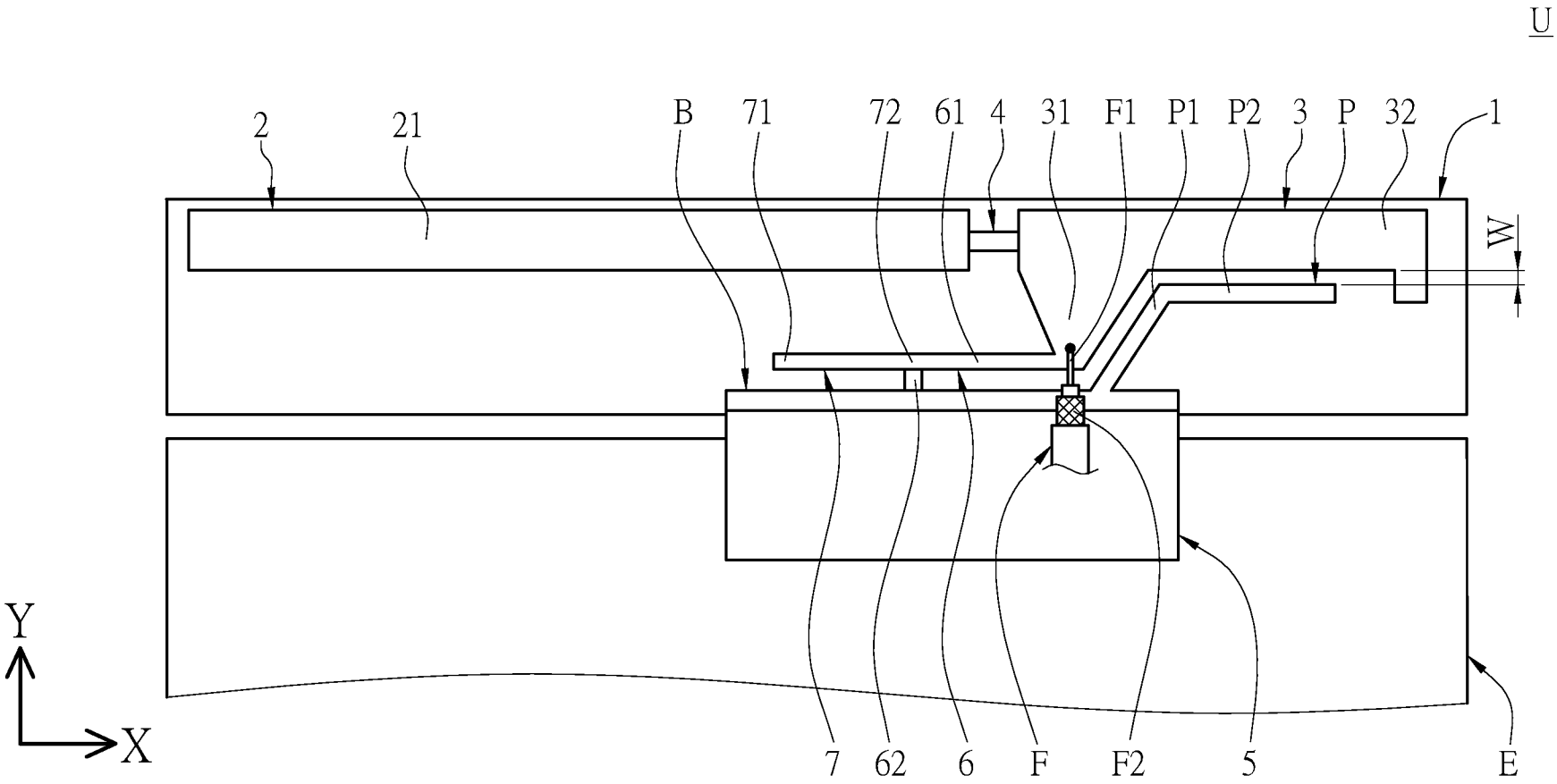
FIG. 9 is a top view of an antenna structure according to the third embodiment of the present disclosure.

Next, reference is made to FIG. 8 and FIG. 9. FIG. 8 is a schematic circuit architecture diagram of another configuration of an antenna structure according to the third embodiment of the present disclosure, and FIG. 9 is a top view of an antenna structure according to the third embodiment of the present disclosure. From the comparison between FIG. 8 and FIG. 6, it can be see that in the embodiment of FIG. 8, the antenna structure U can further include a parasitic element P. And from the comparison between FIG. 8 and FIG. 7, it can be seen that in the embodiment of FIG. 8, the antenna structure U can further include a stub 7, and the first conducting element 6 can include a first conducting body 61 and a second inductor 62. In other words, by adopting the stub 7, the second inductor 62, and the parasitic element P, the antenna structure U in the embodiment of FIG. 8 can have the characteristics respectively generated by the above-identified elements as discussed supra in the present disclosure.

Next, referring again to FIG. 9, it is worth noting that the parasitic element P provided adjacent to the second radiating portion 32 of the antenna structure U can be used to enhance the characteristics of the operating frequency band (second operating frequency band) of the second radiating portion 32. Preferably, the gain in the first frequency band range and the second frequency band range within the second operating frequency band can be strengthened or enlarged. In addition, a predetermined slit W can be provided between the second parasitic portion P2 of the parasitic element P and the second radiating portion 32 (that is, the distance between the second parasitic part P2 of the parasitic part P and the second radiating part portion 32). By adjusting the width of the predetermined slit W between the second parasitic portion P2 and the second radiating portion 32, the impedance values corresponding to the center frequencies of the first frequency band range and the second frequency band range within the second operating frequency band can be adjusted, thereby the value of voltage standing wave ratio (VSWR) corresponding to the center frequency of the operating frequency band can also be adjusted. In other words, the gain of the first frequency band range and the second frequency band range within the second operating frequency band can be increased by adopting the parasitic element P.

Further, as shown in FIG. 9, the antenna structure U can further include a bridging element B. The bridging element B can be disposed on the substrate 1, and can be coupled between the ground element 5 and the first conducting element 6. In other words, one end (not labeled in the figure) of the first conducting element 6 can be coupled to the feed receiving portion 31, and the other end (not labeled in the figure) of the first conducting element 6 can be coupled to the bridging element B, so that the first conducting element 6 is coupled to the ground element 5 through the bridging element B. In addition, the feeding terminal F1 of the feeding element F can be coupled to the feed receiving portion 31. The ground terminal F2 of the feeding element F can be coupled to the bridging element B, so that the feeding element F is coupled to the ground element 5 through the bridging element B. Moreover, in the embodiment of FIG. 9, the bridging element B can be coupled between the ground element 5, the second inductor 62 of the first conducting element 6, and the feeding element F.

Further, it is worth noting that, one of the purposes of adopting the bridging element B is for the ground element 5 to be easily adhered onto the substrate 1, and despite that the bridging element B is provided in the embodiment of FIG. 9, the bridging element B may be omitted in other embodiments. In certain embodiments, the material of bridging element B can be lead or other kinds of conducting material, and the material of the ground element can be copper or other kinds of conducting material. However, the present disclosure is not limited thereto.

In addition, it is particularly noted that, the antenna structure provided in the third embodiment can operate in the first operating frequency band and the first frequency band range, the second frequency band range and the third frequency band range of the second operating frequency band. The other structural features shown in the third embodiment are similar to those described in the foregoing embodiment(s), and are not to be repeated herein.

Figure 10:
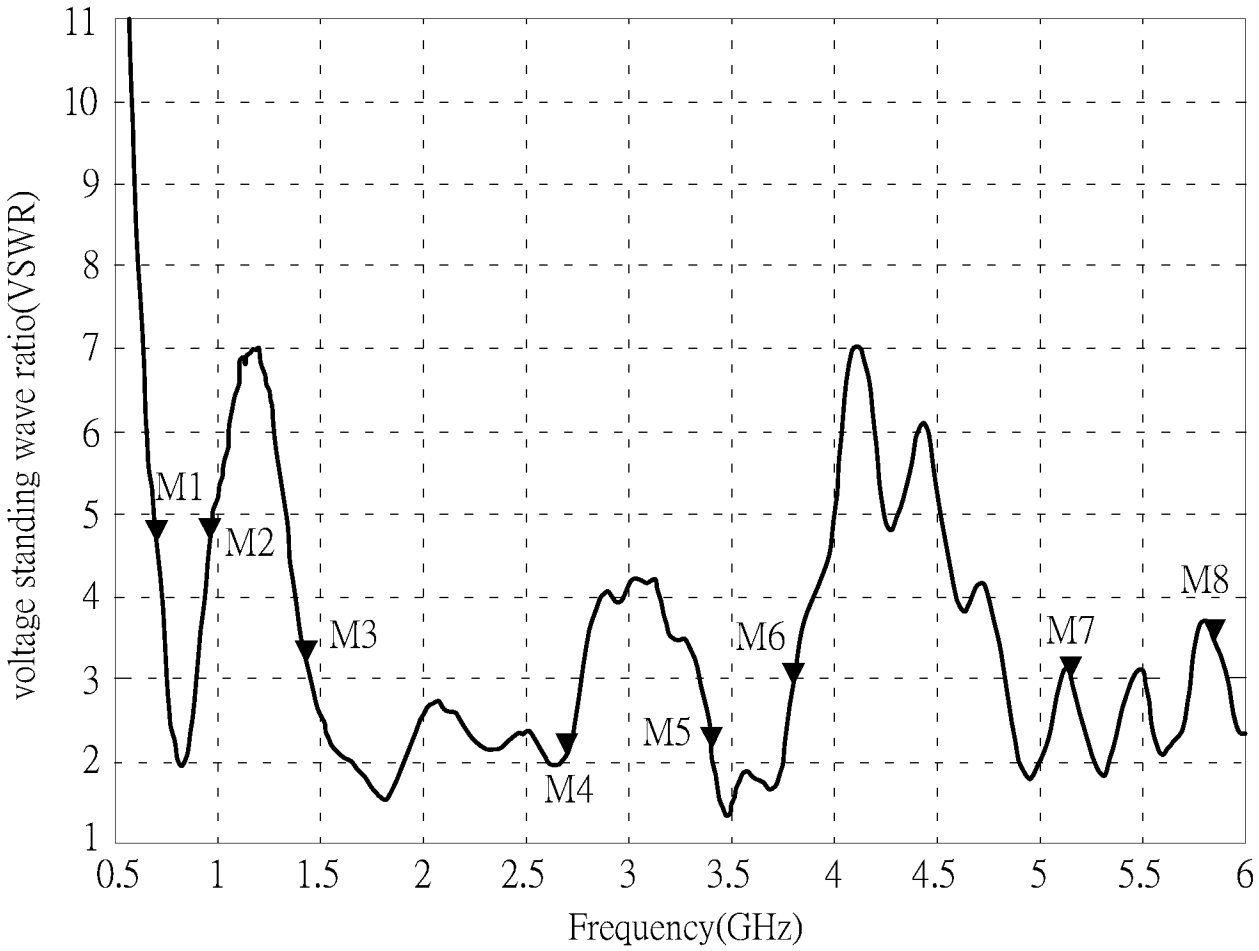
FIG. 10 is a voltage standing wave ratio (VSWR) curve diagram of the antenna structure at different frequencies according to the third embodiment of the present disclosure.

Next, reference is made both to table 1 as follows and FIG. 10. FIG. 10 is a VSWR curve diagram of the antenna structure at different frequencies according to the third embodiment of the present disclosure.

TABLE 1

| Node | Frequency (MHz) | VSWR |
|---|---|---|
| M1 | 698 | 4.67 |
| M2 | 960 | 4.71 |
| M3 | 1425 | 3.20 |
| M4 | 2690 | 2.05 |
| M5 | 3400 | 2.18 |
| M6 | 3800 | 2.94 |
| M7 | 5150 | 3.03 |
| M8 | 5850 | 3.48 |

Fourth Embodiment

Figure 11:
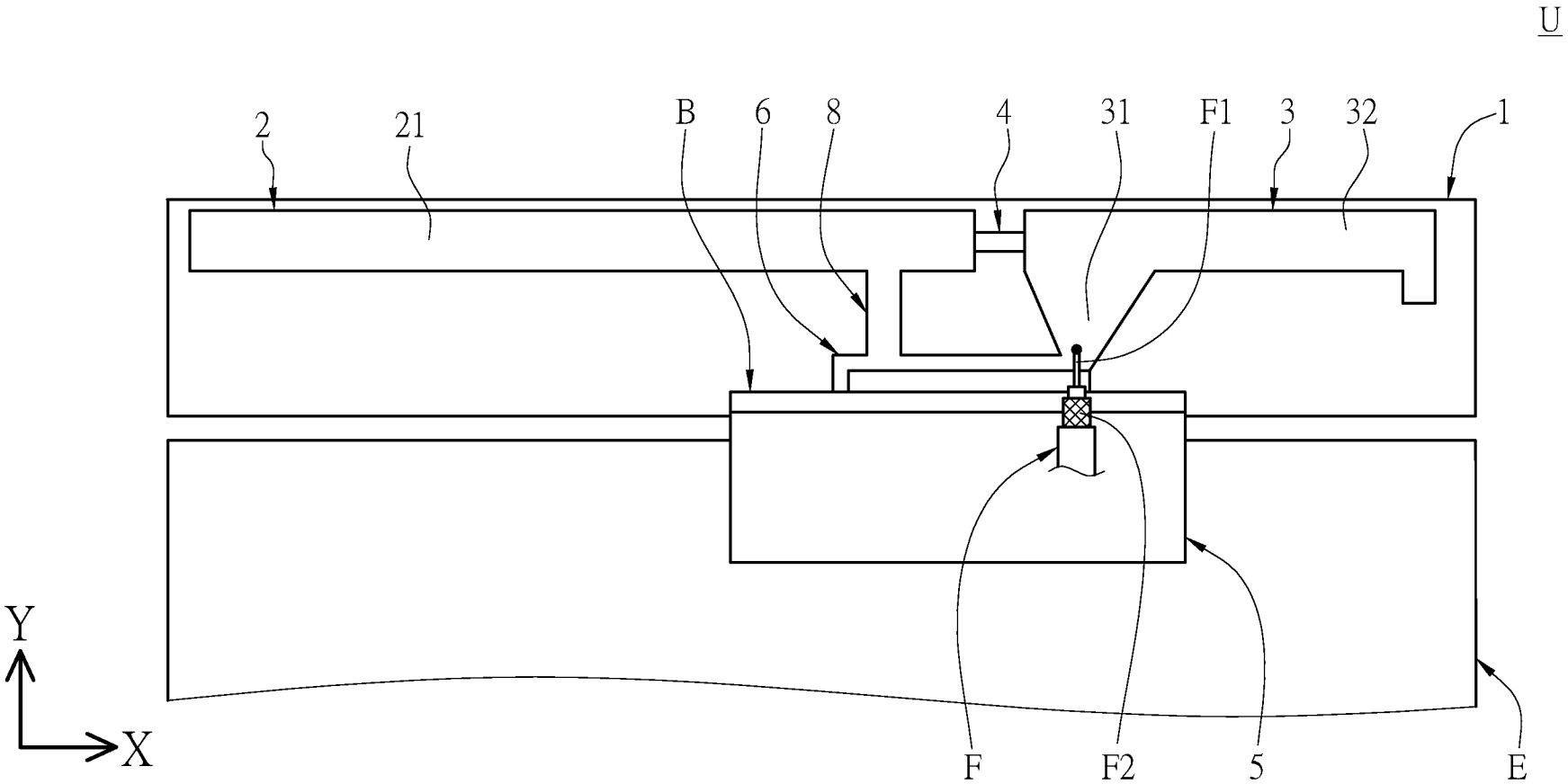
FIG. 11 is a top view of an antenna structure according to a fourth embodiment of the present disclosure.
Figure 12:
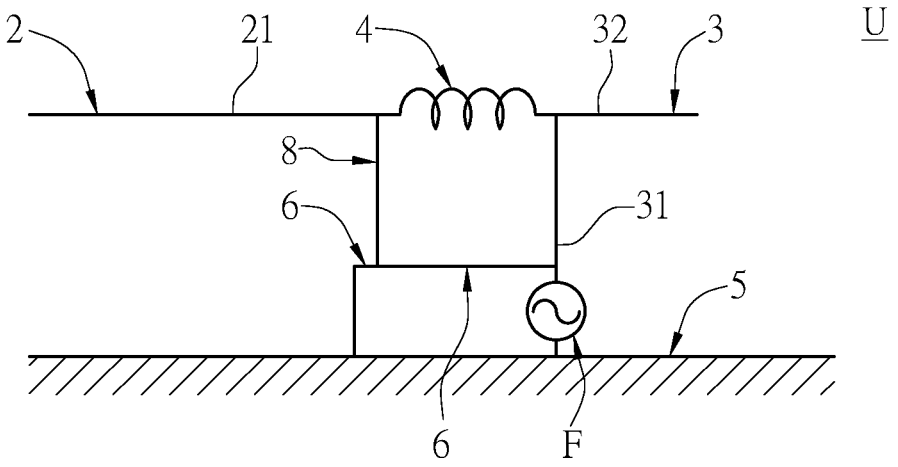
FIG. 12 is a schematic circuit architecture diagram of one configuration of an antenna structure according to the fourth embodiment of the present disclosure.

First, reference is made to FIG. 11 and FIG. 12. FIG. 11 is a top view of an antenna structure according to a fourth embodiment of the present disclosure, and FIG. 12 is a schematic circuit architecture diagram of a configuration of an antenna structure according to the fourth embodiment of the present disclosure.

Comparing FIG. 11 and FIG. 12 with FIG. 1 and FIG. 2, it can be seen that one of the differences between the fourth embodiment and the first embodiment is that, the antenna structure U provided by the fourth embodiment can further include a second conducting element 8. In the fourth embodiment, the second conducting element 8 can be coupled between the first radiating element 2 and the first conducting element 6, so that a loop is formed among and by the second radiating element 3, the first inductor 4, the first radiating element 2, the second conducting element 8 and the first conducting element 6. In this way, the gain of the second frequency band range within the second operating frequency band is increased.

In certain embodiments, an electrical length of the loop formed among and by the second radiating element 3, the first inductor 4, the first radiating element 2, the second conducting element 8 and the first conducting element 6 is preferably one fourth (¼) of the wavelength of the lowest operating frequency of the second frequency band range within the second operating frequency band. However, the present disclosure is not limited thereto.

Figure 13:
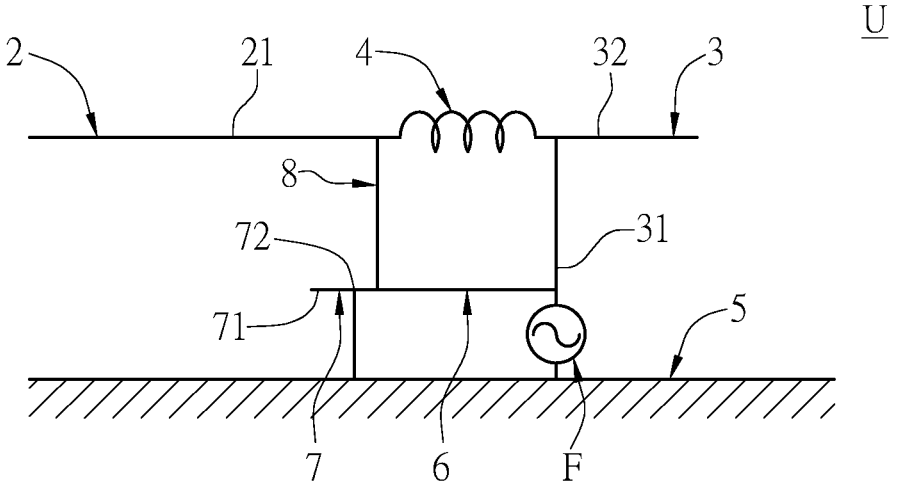
FIG. 13 is a schematic circuit architecture diagram of another configuration of an antenna structure according to the fourth embodiment of the present disclosure.
Figure 14:
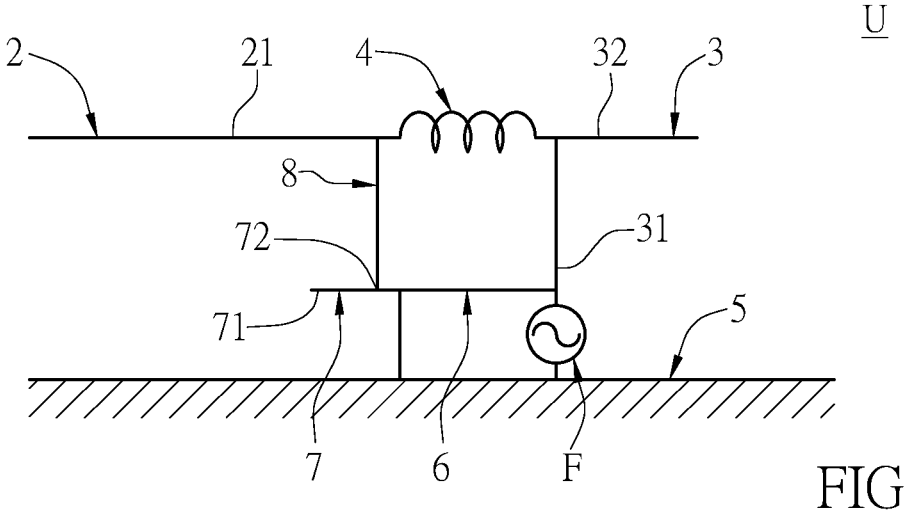
FIG. 14 is a schematic circuit architecture diagram of still another embodiment of an antenna structure according to the fourth embodiment of the present disclosure.

Next, reference is made to FIGS. 13-17, which are schematic circuit architecture diagrams of different configurations according to the fourth embodiment of the present disclosure. As shown in FIGS. 13 and 14, by comparing FIGS. 13 and 14 with FIG. 12, it can be seen that the antenna structure U of the embodiments in FIGS. 13 and 14 can further include a stub 7. The stub 7 can have an open end 71 and a connecting end 72 coupled to the first conducting element 6. In addition, the adoption of the stub 7 allows adjustment of the center frequency of the third frequency band range within the second operating frequency band. Further, from the comparison between FIG. 13 and FIG. 14, it can be seen that the location of the connecting end 72 of the stub 7 changes according to the change of the coupled location of the second conducting element 8 to the first conducting element 6. However, it is noted that the location of the connecting end 72 of the stub 7 is defined as a location on the stub 7 corresponding to the first node counted from the open end 71 of the stub 7.

Figure 15:
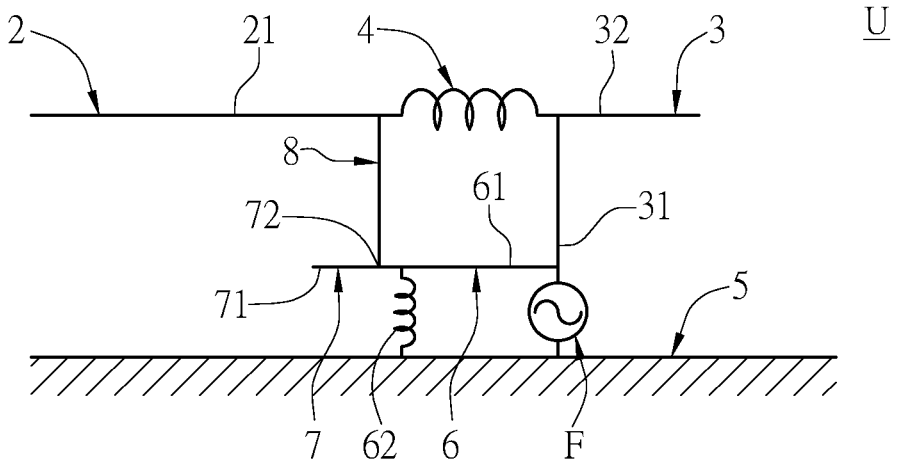
FIG. 15 is a schematic circuit architecture diagram of yet another configuration of an antenna structure according to the fourth embodiment of the present disclosure.
Figure 16:
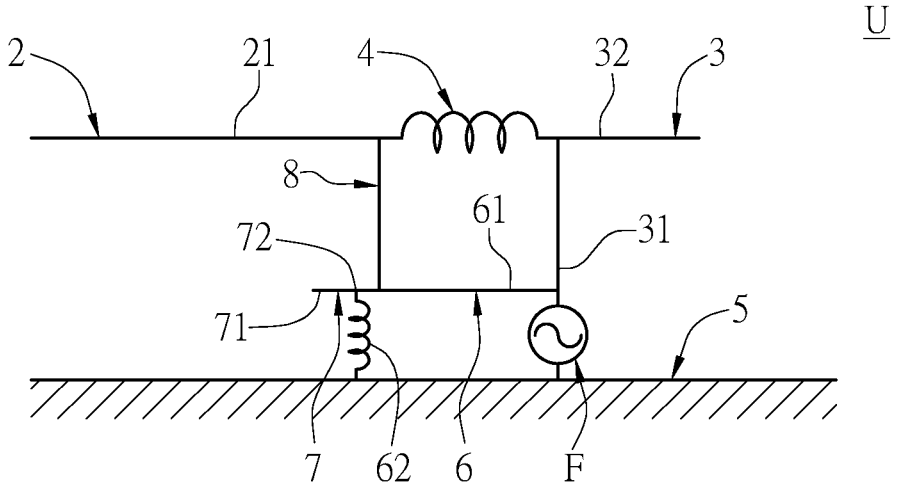
FIG. 16 is a schematic circuit architecture diagram of yet another configuration of an antenna structure according to the fourth embodiment of the present disclosure.

Next, as shown in FIGS. 15 and 16, by comparing FIGS. 15 and 16 with FIGS. 13 and 14, it can be seen that the first conducting element 6 in the embodiments of FIGS. 15 and 16 can include a first conducting body 61 and a second inductor 62, thereby allowing the adjustment of the impedance value corresponding to the center frequency of the first operating frequency band through adjusting the inductance value of the second inductor 62.

Figure 17:
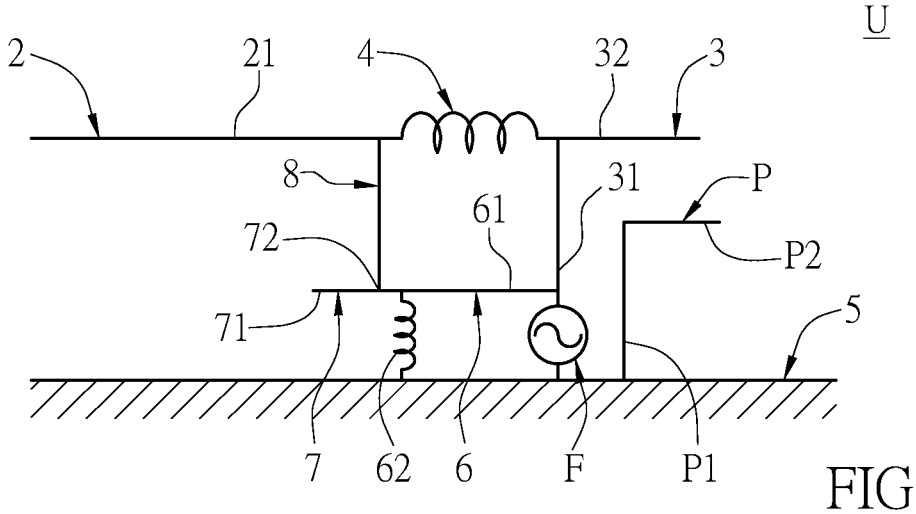
FIG. 17 is a schematic circuit architecture diagram of yet another configuration of an antenna structure according to the fourth embodiment of the present disclosure.

Next, reference is made to FIG. 17. From the comparison between FIG. 17 and FIG. 15, it can be seen that the antenna structure U of the embodiment of FIG. 17 can further include a parasitic element P. The adoption of the parasitic element P increases the gain of the first frequency band range and the second frequency band range of the second operating frequency band. In addition, it is noted that a parasitic element of FIG. 17 can also be adopted in the embodiment of FIG. 16, so as to increase the gain of the first frequency band range and the second frequency band range of the second operating frequency band. Further, it is also noted that, the antenna structure U provided by the fourth embodiment can operate in the first operating frequency band and the first frequency band range, the second frequency band range and the third frequency band range of the second operating frequency. The other structural features shown in the fourth embodiment are similar to those described in the foregoing embodiment(s), and are not to be repeated herein.

Fifth Embodiment

Figure 18:
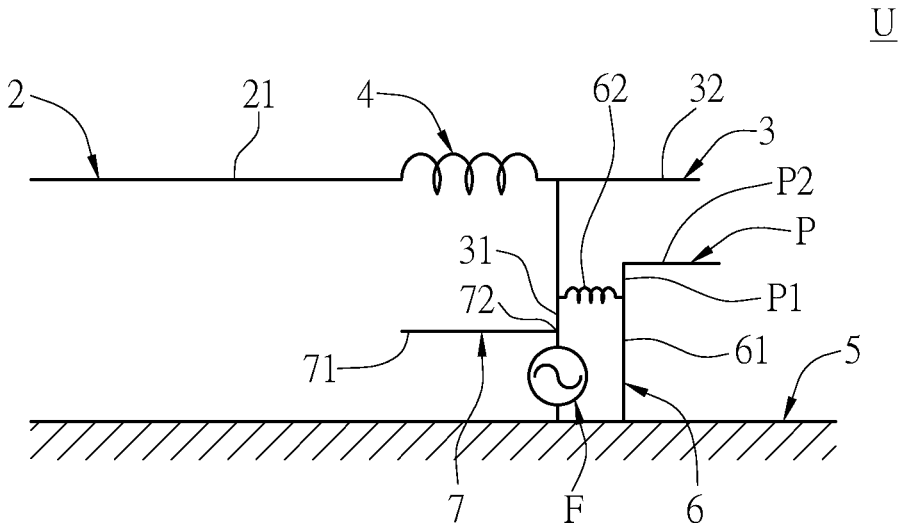
FIG. 18 is a schematic circuit architecture diagram of a configuration of an antenna structure according to a fifth embodiment of the present disclosure.

First, reference is made both to FIG. 18 and FIG. 5. FIG. 18 is a schematic circuit architecture diagram of a configuration of an antenna structure according to a fifth embodiment of the present disclosure. By comparing FIG. 18 with FIG. 5, it can be seen that the antenna structure U of the embodiment of FIG. 18 can further include a parasitic element P and a stub 7. The first conducting element 6 includes a first conducting body 61 and a second inductor 62. Further, as shown in FIG. 18, the first conducting element 6 can be coupled between the feed receiving portion 31 and the ground element 5, and the parasitic element P can be coupled to the first conducting element 6 and arranged adjacent to the second radiating portion 32. In addition, the parasitic element P has a first parasitic portion P1 coupled to the first conducting element 6 and a second parasitic portion P2 bent from the first parasitic portion P1 and extending along a direction away from the feed receiving portion 31. The second inductor 62 can be coupled between the feed receiving portion 31 and the parasitic element P. In addition, the stub 7 can have an open end 71 and a connecting end 72 coupled to the feed receiving portion 31. In this way, the antenna structure U in the embodiment of FIG. 18 can have the characteristics respectively generated by the above-identified elements as discussed supra in the present disclosure.

Figure 19:
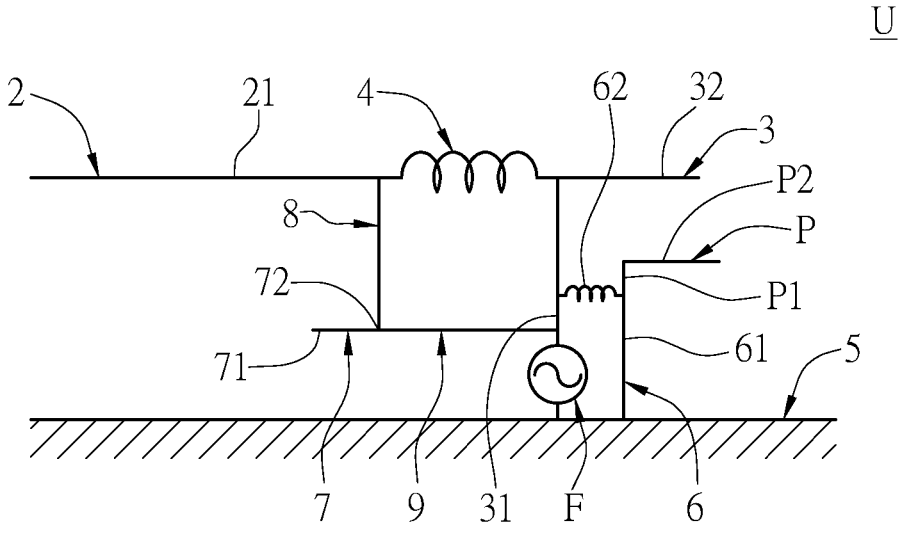
FIG. 19 is a schematic circuit architecture diagram of another configuration of an antenna structure according to the fifth embodiment of the present disclosure.
Figure 20:
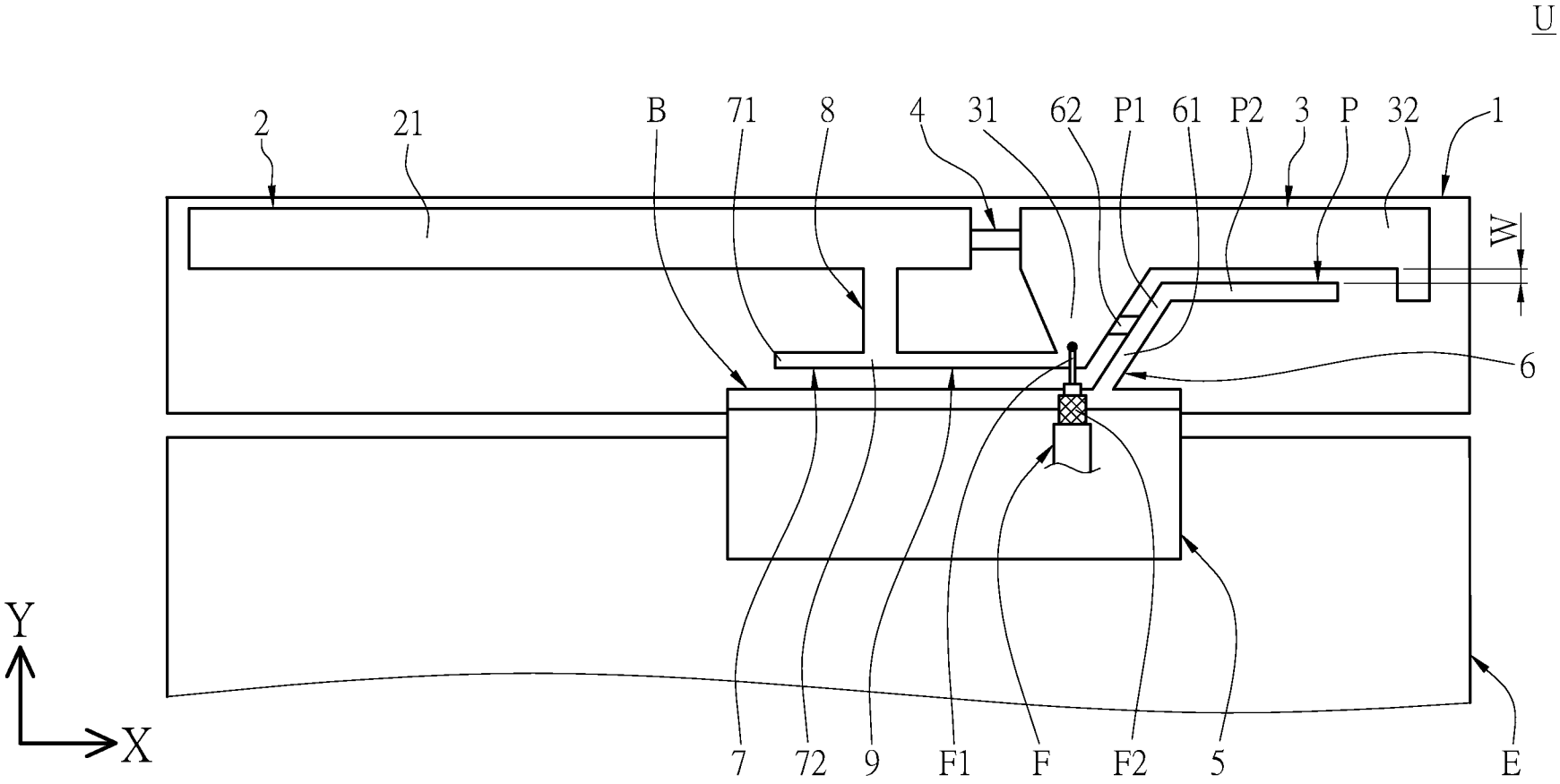
FIG. 20 is a top view of an antenna structure according to the fifth embodiment of the present disclosure.

Next, reference is made to FIG. 19 and FIG. 20. FIG. 19 is a schematic circuit architecture diagram of the antenna structure of another configuration according to the fifth embodiment of the present disclosure, and FIG. 20 is a top view of an antenna structure according to the fifth embodiment of the present disclosure. As can be seen from the comparison between FIG. 19 and FIG. 18, in the embodiment of FIG. 19, a second conducting element 8 and a third conducting element 9 can be further included.

Thereby, a loop is formed to increase the gain of the second frequency band range within the second operating frequency band.

Specifically, one end (not labeled in the figure) of the third conducting element 9 can be coupled to the feed receiving portion 31, and the other end (not labeled in the figure) of the third conducting element 9 can be coupled to the connecting end 72 of the stub 7. The second conducting element 8 can be coupled between the first radiating element 2 and the third conducting element 9 to form a loop. In this way, in the embodiments of FIG. 19 and FIG. 20, the antenna structure U has the second inductor 62, the stub 7, the parasitic element P, and the second conducting element 8. Therefore, the antenna structure U can have the characteristics respectively generated by the above-identified elements as discussed supra in the present disclosure. It should be particularly noted that the antenna structure U provided by the fifth embodiment is operable in the first operating frequency band and the first frequency band range, the second frequency band range and the third frequency band range of the second operating frequency band.

One of the beneficial effects of the present disclosure is that, through the technical features of "the inductor 4 being coupled between the first radiating element 2 and the second radiating element 3," the antenna structure U of the present disclosure can suppress the mutual influence between different frequency bands. Specifically, the signal of the first radiating element 2 can be prevented from affecting the signal of the second radiating element 3. That is, the matching effect of the second radiating element 3 can be increased, preventing the second radiating element 3 from being affected by the multiplied frequencies and frequency multiplication of the first radiating element 2. Preferably, the present disclosure prevents the first frequency band range within the second operating frequency band from being affected by the first radiating element 2.

Further, in the embodiments of the first conducting element 6 having a second inductor 62, the impedance value corresponding to the center frequency of the first operating frequency band can be adjusted by adjusting the inductance value of the second inductor 62. Further, in the embodiments of the antenna structure U having the parasitic element P, the gain of the first frequency band range and the second frequency band range of the second operating frequency band can be increased. Further, in the embodiments of the antenna structure U having the stub 7, the center frequency of the third frequency band range within the second operating frequency band can be adjusted. Further, in the embodiments of the antenna structure U having the loop formed by the second conducting element 8, the gain of the second frequency band range of the second operating frequency band can be increased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a substrate;

a first radiating element disposed on the substrate;

a second radiating element disposed on the substrate and having a feed receiving portion;

a first inductor coupled between the first radiating element and the second radiating element;

a ground element;

a first conducting element coupled between the feed receiving portion and the ground element, and the first conducting element having a first conducting body and a second inductor coupled to the first conducting body; and a feeding element coupled between the feed receiving portion and the ground element and configured to feed in a signal.

2. The antenna structure according to claim 1, further comprising:

a stub having an open end and a connecting end coupled to the first conducting element.

3. The antenna structure according to claim 2, wherein the first conducting body has an end coupled to the feed receiving portion and another end coupled to the connecting end of the stub, and the second inductor has an end coupled to the another end of the first conducting body and another end coupled to the ground element.

4. The antenna structure according to claim 3, wherein the second inductor has an inductance value between 2.7 nanohenries (nH) and 15 nH.

5. The antenna structure according to claim 1, further comprising a parasitic element disposed on the substrate, coupled to the ground element and having a first parasitic portion coupled to the ground element; and a second parasitic portion bent from the first parasitic portion and extending along a direction away from the feed receiving portion.

6. The antenna structure according to claim 5, further comprising:

a stub having an open end and a connecting end coupled to the first conducting element.

7. The antenna structure according to claim 6, wherein the first conducting body has an end coupled to the feed receiving portion and another end coupled to the connecting end of the stub; and the second inductor has an end coupled to the another end of the first conducting body and another end coupled to the ground element.

8. The antenna structure according to claim 1, further comprising a second conducting element coupled between the first radiating element and the first conducting element to form a loop.

9. The antenna structure according to claim 8, further comprising:

a stub having an open end and a connecting end coupled to the first conducting element.

10. The antenna structure according to claim 9, wherein the first conducting body has an end coupled to the feed receiving portion and another end coupled to the connecting end of the stub; and the second inductor has an end coupled to the another end of the first conducting body and another end coupled to the ground element.

11. The antenna structure according to claim 10, further comprising a parasitic element disposed on the substrate, coupled to the ground element and having a first parasitic portion coupled to the ground element; and a second parasitic portion bent from the first parasitic portion and extending along a direction away from the feed receiving portion.

12. The antenna structure according to claim 1, further comprising a parasitic element disposed on the substrate, coupled to the first conducting element and having a first parasitic portion coupled to the first conducting element; and a second parasitic portion bent from the first parasitic portion and extending along a direction away from the feed receiving portion, wherein the second inductor is coupled between the feed receiving portion and the parasitic element.

13. The antenna structure according to claim 12, further comprising:

a stub having an open end and a connecting end coupled to the feed receiving portion.

14. The antenna structure according to claim 12, further comprising:

a stub having an open end and a connecting end;

a second conducting element;

a third conducting element having an end coupled to the feed receiving portion and another end coupled to the connecting end of the stub, wherein the second conducting element is coupled between the first radiating element and the third conducting element to form a loop.

15. The antenna structure according to claim 1, further comprising:

a stub having an open end and a connecting end coupled to the feed receiving portion.

16. The antenna structure according to claim 1, wherein the first inductor has an inductance value between 1 nH and 30 nH.

17. An antenna structure, comprising:

a substrate;

a first radiating element disposed on the substrate;

a second radiating element disposed on the substrate and having a feed receiving portion;

a first inductor coupled between the first radiating element and the second radiating element;

a ground element;

a first conducting element directly connected between the feed receiving portion and the ground element;

a second conducting element directly connected between the first radiating element and the first conducting element to form a loop; and a feeding element coupled between the feed receiving portion and the ground element and configured to feed in a signal.

18. An antenna structure, comprising:

a substrate;

a first radiating element disposed on the substrate;

a second radiating element disposed on the substrate and having a feed receiving portion;

a first inductor coupled between the first radiating element and the second radiating element;

a ground element;

a first conducting element directly connected between the feed receiving portion and the ground element;

a feeding element coupled between the feed receiving portion and the ground element and configured to feed in a signal; and a stub having an open end and a connecting end directly connected to the first conducting element;

wherein an extension direction of the stub is the same as an extension direction of the first radiating element.

19. An antenna structure, comprising:

a substrate;

a first radiating element disposed on the substrate;

a second radiating element disposed on the substrate and having a feed receiving portion;

a first inductor coupled between the first radiating element and the second radiating element;

a ground element;

a first conducting element directly connected between the feed receiving portion and the ground element;

a feeding element coupled between the feed receiving portion and the ground element and configured to feed in a signal; and a stub having an open end and a connecting end directly connected to the feed receiving portion;

wherein an extension direction of the stub is the same as an extension direction of the first radiating element.

* * * * *